US007954444B2

(12) United States Patent
Smith

(10) Patent No.: US 7,954,444 B2
(45) Date of Patent: Jun. 7, 2011

(54) READING TOOL

(76) Inventor: Sylvia R. Smith, Aurora, IL (US)

( * ) Notice: Subject to any disclaimer, the term of this patent is extended or adjusted under 35 U.S.C. 154(b) by 429 days.

(21) Appl. No.: 11/654,305

(22) Filed: Jan. 18, 2007

(65) Prior Publication Data

US 2008/0173232 A1 Jul. 24, 2008

(51) Int. Cl.
*B42D 9/00* (2006.01)

(52) U.S. Cl. ..... 116/240; 116/235; 33/566

(58) Field of Classification Search ..... 116/240, 116/234, 235; 33/562–564, 566; 434/181, 434/348, 404–405
See application file for complete search history.

(56) References Cited

U.S. PATENT DOCUMENTS

| | | | | | |
|---|---|---|---|---|---|
| 140,135 | A * | 6/1873 | Hildreth | 434/178 |
| 573,973 | A * | 12/1896 | Harris et al. | 33/566 |
| 1,658,499 | A * | 2/1928 | Stevens | 116/240 |
| 3,248,050 | A * | 4/1966 | Dickson | 235/89 R |
| 3,251,141 | A * | 5/1966 | MacRae | 434/331 |
| 3,287,827 | A * | 11/1966 | Lippman | 434/348 |
| 3,352,487 | A * | 11/1967 | Olsen et al. | 235/89 R |
| 3,376,650 | A * | 4/1968 | Cook | 33/566 |
| 3,408,977 | A * | 11/1968 | Colman, Jr. | 116/240 |
| 3,704,533 | A * | 12/1972 | Weber | 434/181 |
| 3,739,739 | A * | 6/1973 | Brase | 116/240 |
| 3,982,332 | A * | 9/1976 | Szymczak | 434/181 |
| 4,016,659 | A * | 4/1977 | Merrigan | 434/181 |
| 4,024,831 | A * | 5/1977 | Sperling | 33/493 |
| 4,641,444 | A * | 2/1987 | Signor | 40/352 |
| 4,832,373 | A * | 5/1989 | Swan | 283/115 |
| D310,971 | S * | 10/1990 | Friedman | D10/62 |
| 5,377,046 | A * | 12/1994 | Ryan | 359/599 |
| 5,785,315 | A * | 7/1998 | Eiteneer et al. | 273/139 |
| 5,950,560 | A * | 9/1999 | Block et al. | 116/240 |
| 6,832,915 | B1 * | 12/2004 | Kirby | 434/178 |
| 6,839,971 | B2 * | 1/2005 | Schafer et al. | 33/1 B |
| 7,056,122 | B2 * | 6/2006 | Lockett | 434/181 |
| 7,287,339 | B2 * | 10/2007 | Robertson | 33/562 |
| 2005/0106541 | A1 * | 5/2005 | Lockett | 434/181 |
| 2006/0048403 | A1 * | 3/2006 | Brister | 33/566 |
| 2006/0073446 | A1 * | 4/2006 | Lockett | 434/181 |

* cited by examiner

*Primary Examiner* — R. A. Smith
*Assistant Examiner* — Tania C Courson
(74) *Attorney, Agent, or Firm* — Gregory B. Beggs

(57) ABSTRACT

A tool for assisting a reader in grasping the thought expressed in a group of words on a page is disclosed. The tool is a flexible film card which has a window adjacent contrastingly colored film segments of the card. A group of words may be viewed through the window, and the window may then be moved by the user from one group of words to the next. The groups all around the window may be viewed through the colored segments of the card, thus allowing the reader's eyes to review and anticipate the passages of words which he has read or those which he is about to read while still focusing his attention on the group of words in the window.

14 Claims, 2 Drawing Sheets

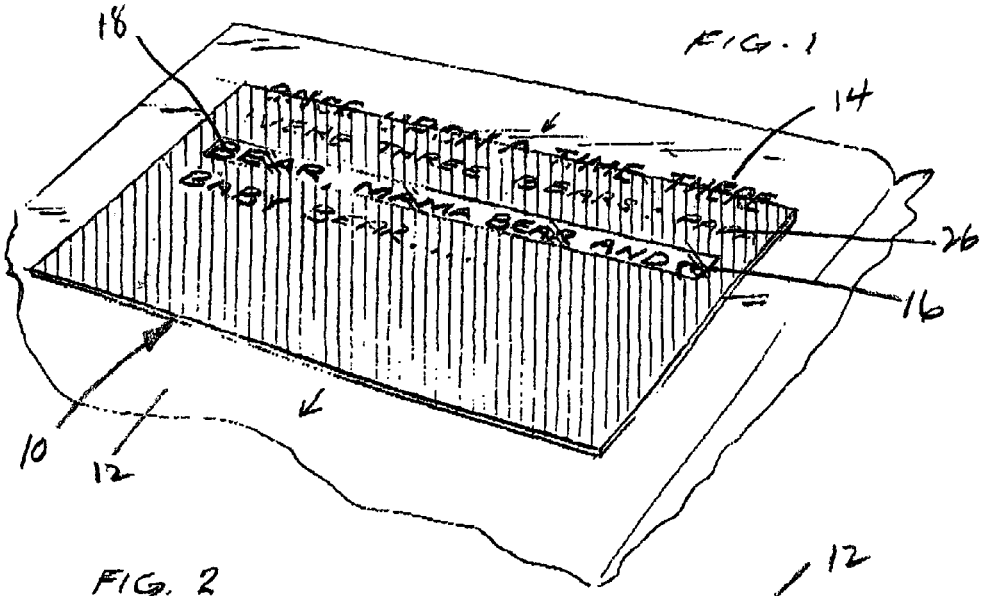
FIG. 1
FIG. 2
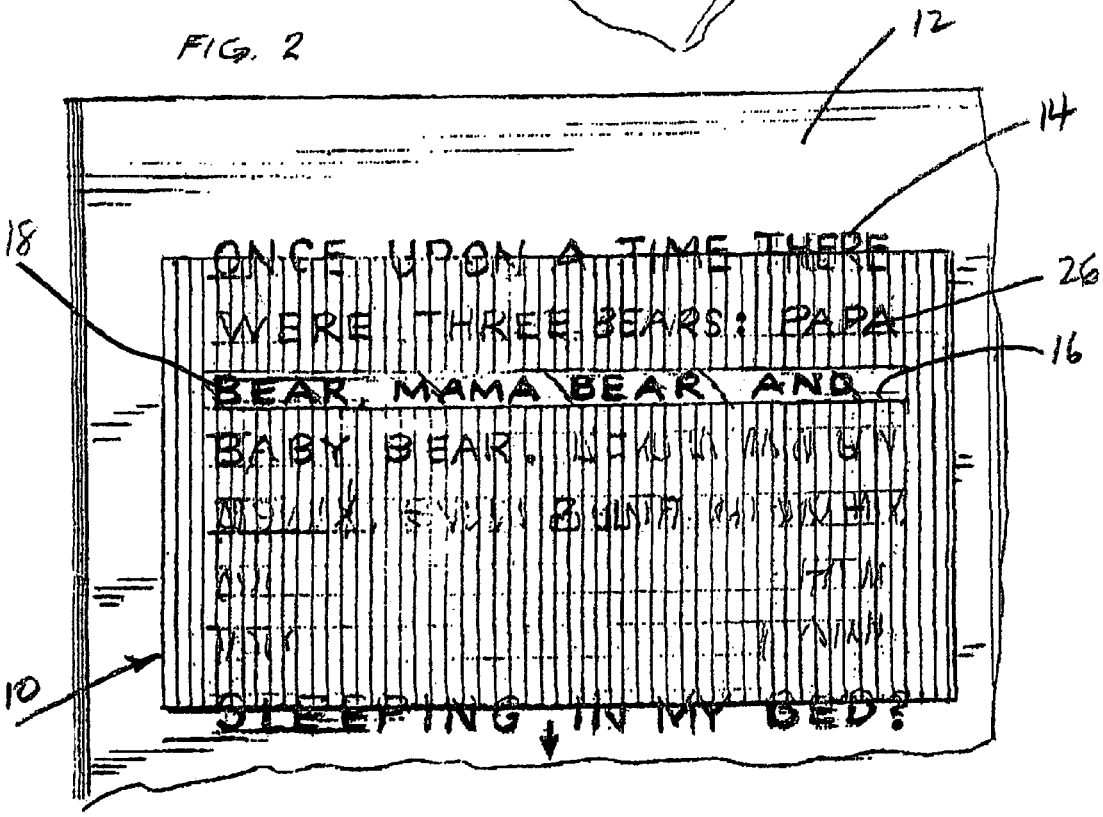

READING TOOL

This invention relates to tools which assist a reader in grasping the thought expressed in a group of words appearing in a page of text. More particularly, it relates to a flexible film card having a window adjacent to a contrastingly colored segment of the card in a combination which allows the user to move the window of the card from one group of words to the next and also helps him to focus more on the meaning of the words in each group and less on keeping his place somewhere on the page. Simultaneously, the tool allows a user to review portions of the text outside of the window which he has just passed and to anticipate the passages which he is moving the window to next, thus progressing through the text easily from one thought to the one that follows.

BACKGROUND OF THE INVENTION

Reading involves the identification and localization of three key elements, according to S. Fowler in his paper on visual problems associated with reading and spelling difficulties, Information Sheet Number 5, Professional Association of Teachers of Students with Specific Learning Difficulties (2000). These key elements are (1) visual reference points for the lines involved in letter construction, (2) memory of what is seen, followed by (3), the association of meaning and language.

Smooth eye movement is essential for successful readers, according to D. A. Robinson in Neurophysiology of Eye Movements, Annual Review, Neuroscience 4, pages 463-503 (1981). He determined that the control of saccades, which is a rapid movement of the eye as it changes focus from one point to another, for example, while reading, and smooth pursuit, fixation and convergence, i.e., a coming together from different directions, play an important part in producing a stable image of the word on the page and enable smooth tracking of the eyes along a line of print. Thus, the accurate control of involuntary, i.e., jump, eye movements and of smooth, continuous eye movements is necessary for reading.

Princeton University's Dr. George A. Miller in an article in The Psychological Review entitled "The Magical Number Seven, Plus or Minus Two: Some Limits on Our Capacity for Processing Information" (1956) explored the optimal amount of information that a person's short-term memory could receive and effectively process. After analyzing a variety of experiments on the capacity of people to transmit information, Dr. Miller concluded that the amount of information or "variance" which humans most successfully process is "seven, plus or minus two" or, in other words, five to nine units, or "chunks," of information at one time.

Subsequently, A. J. Wilkins and Nimmo-Smith published the results of their study on the reduction of eyestrain in Ophthalmic and Physiological Optics (1) at pages 53-59 (1984). They reported: "Some children and adults with or without reading problems complain of glare of the black print against the white background [or] light shining on white rather than blackboards. Basically the background appears to interfere with the print. They may see patterns in the gaps between line and words, which can be distracting [and] can cause headache and migraines (sic)."

More recently, in the study which I. Iovino, J. M. Fletcher, B. G. Breitmeyer and B. R. Foorman published in 1998 in the Journal of Clinical and Experimental Neuropsychology, Vol. 20, No. 6, pages 791-806, a study which was grounded in the Wilkins and Nimmo-Smith work, the authors discovered that the individuals in their research who were sensitive as they read to glare or print against a light background more often chose a blue/mauve (end of the color spectrum) overlay to help them as they read. Both they and Fowler concluded that "Blue not only appears to reduce glare, but also the apparent motion of the print."

Very recent studies analyzing the role of attention in absorbing information which appears in printed material are reported by Kowler Ph. D., of Rutgers University's Department of Psychology in New Encyclopedia of Neuroscience (2006). She concludes that "Eye movements are inextricably linked to visual attention because both are the principal tools available for selecting interesting portions of visual scenes for enhanced perceptual and cognitive processing." She concludes also that "The picture of saccades and attention that emerges from the psychophysical and behavior studies . . . which is in agreement with neurophysiological work, is that saccades and attention normally operate in a connected fashion, with saccades landing at the object that is the main focus of attention. Nevertheless, attending to the goal of saccades still allows perceptual processing at different locations, perhaps with the aid of other mechanisms that passively distribute attention to relevant locations in parallel across the visual array."

Various issued patents disclose aids which utilize viewing windows or viewing strips to direct eye movement. They are addressed to devices for specific situations such as viewing computer printouts or tables, or to several forms of training devices. One of the former is disclosed in U.S. Pat. No. 3,739,739, issued in 1973. It describes a flexible strip which incorporates a crystal clear band extending from one end of the strip to the other. Preferably, the strip is longer than fifteen inches in order to extend the full width of a computer printout and beyond. The ends of the strip project out from the edges of the printout so that they can be gripped by the user as he moves down the page. Dark stripes border the band along its top and bottom edges and focus attention on the material within the band. Another type of strip is disclosed in U.S. Pat. No. 4,024,831, issued in 1977, describing a transparent ruler having a central colored strip throughout its length arranged between scales which are located along the top and bottom edges of the ruler. Optionally, one of the scales may be replaced by a tinted section, and in that case the center strip is bordered by lines of a contrasting color. Flexible forms of overlays are described in U.S. Pat. No. 5,950,560 which issued in 1999. In that patent, transparent colored bands of film covering several lines of text are disclosed, pink, orange, yellow, blue, violet, green, sky blue, etc., and the reader selects which one or ones are the least troublesome as he reads. Another device, a line finder for typists, is disclosed in U.S. Pat. No. 1,658,499 which issued in 1928. That patent describes a plate of glass, preferably about ¼" thick, which has a line on its undersurface created by painting the lower half of the plate with a transparent coloring material such as green French varnish.

Among the training devices which are disclosed in the patent art, U.S. Pat. No. 3,982,332, issued in 1976, describes a transparent jacket which holds opaque cards, each one having a horizontal slot. The slot may be moved down a column of short letter groups at various speeds to train a user's eye and comprehension. When one speed or group size has been mastered, a longer slot and a longer letter group may be used. Other windows with various opaque bordering elements are disclosed in U.S. Pat. Nos. 140,135; 3,408,977; 3,704,533; 3,982,332; 4,016,659; and 4,641,444.

A similar window card is described in U.S. Pat. No. 5,458,376 which issued in 1995. That card facilitates reading data on a newspaper page containing columns of stock market information. A series of headings which duplicate the headings at the top of the newspaper page, i.e., "abbreviation," "52 wk. high," "52 wk. low," etc., is arranged horizontally across the card above the window, and a transparent vertical area along the edge of the card permits the user to align the window in the card with the identity of the stock which he selects. The advantage of the card is to bring the generalized headings for the data at the top of the newspaper page into immediate proximity to the specific data for a particular stock.

Against this background, it is an object of the present invention to provide an instructive tool which has demonstrated its effectiveness in making reading a page of text easier for the user, and also of making the author's expressed thought more absorbable for the user.

It is a further object of this invention to provide a reading tool which is inexpensive and which can be widely distributed to school children, and which is also capable of being deftly handled by children who are young, beginning readers.

It is a further object of this invention to provide a reading tool which is arranged to focus a user's attention on an absorbable group of words on a page of text and direct that attention smoothly to a following group of words on that page.

It is a further object of this invention to provide a reading tool which concentrates a focused view on a specific group of words in a line of text on a page.

It is a further object of this invention to provide a physical combination of elements in a reading tool which generate a user's eye movement to return to a just read group of words quickly, easily, and without conscious effort.

These and other objects and advantages of the present invention will be apparent to those of skill in the art in view of the detailed description set forth herein.

SUMMARY OF THE INVENTION

The present invention is embodied in a flexible plastic card. The card has a flexible layer of transparent film which is readily conformable to the surface of a page on which there are lines of text to be read. A flexible layer of colored translucent film is adhered to the transparent layer. There is a first window in the transparent layer which may be as large as the layer itself and a second window in the translucent layer. The windows are adjacent to each other, and they disclose a view through them of one of the lines of text. That view contrasts to the colored views of portions of the text which are outside of but contiguous to the second window.

BRIEF DESCRIPTION OF THE DRAWINGS

FIG. 1 is a perspective view of the reading tool of this invention illustrating its conformation to a page on which there are lines of text to be read and the appearance of a line of text in a window of the tool;

FIG. 2 is an enlarged perspective view of the reading tool in FIG. 1;

DETAILED DESCRIPTION OF THE INVENTION

The reading tool of this invention is shown at 10 in FIG. 1 lying upon and conforming to page 12 of a book or similar document on which text 14 appears. Window 16 in reading tool 10 permits a reader to focus on the line 18 of text 14 which appears through the window.

Figure 4:
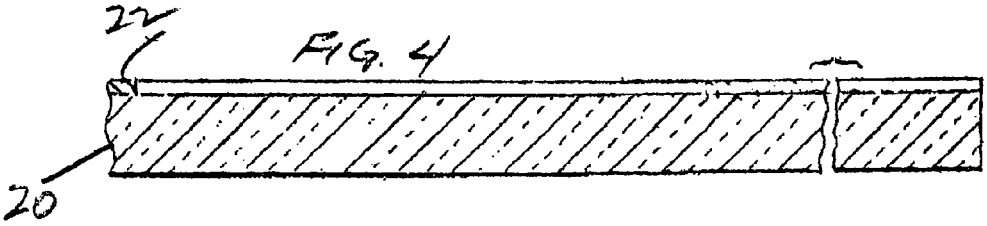
FIG. 4 is an enlarged sectional view in elevation of a portion of the reading tool of FIG. 3 taken along the line 4-4 in FIG. 3.
Figure 5:
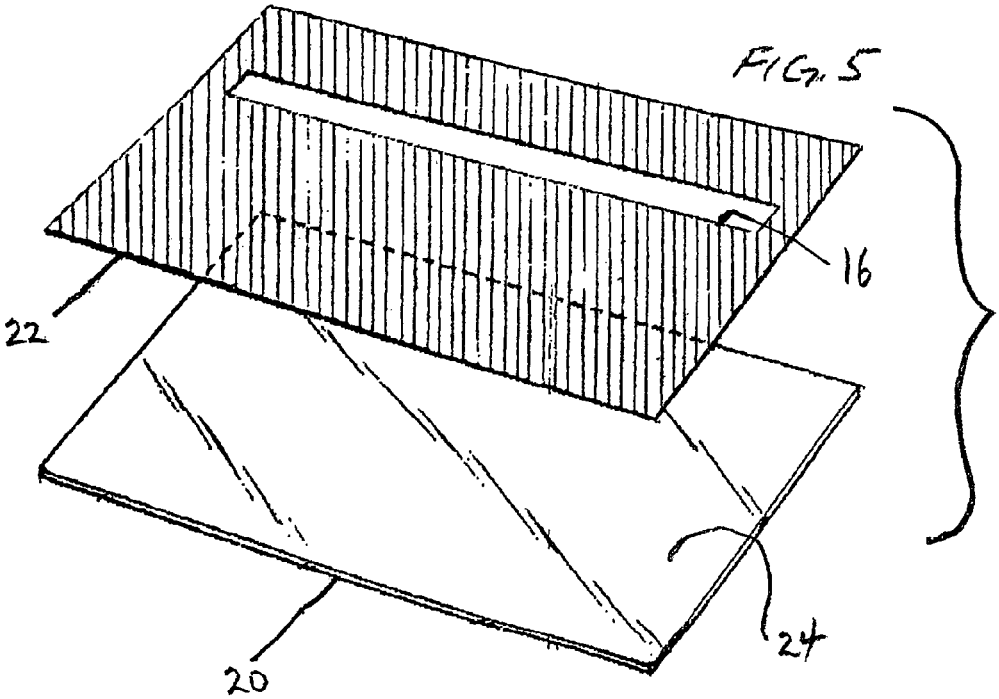
FIG. 5 is an exploded view, in perspective, of the reading tool in FIG. 3.

As appears particularly in FIGS. 4 and 5, reading tool 10 is made up of two layers, a flexible layer 20 of transparent film forming a first panel which is conformable to the surface of page 12 on which text 14 appears, and a second layer 22 of translucent film which is adhered to transparent layer 20. Transparent layer 20 forms a first window 24 and window 16 is a second window, formed in the translucent layer 22 adjacent the first window 24. The first and second windows, 24 and 24, cooperatively disclose a view of The second layer of film, translucent layer 22, as particularly shown in FIG. 5, is a colored film. Window 16 is clear, in contrast to the remainder of layer 22 which is contiguous to and extends outwardly from window 16. Portions 26 of text 14, when viewed through the colored translucent layer contiguous to window 16, contrast to the clear view of the text which appears through the window 16. To a reader who is using tool 10, attention is drawn to the words which appear in window 16, and to the author's thought which is expressed there. Still, to a reader who desires to review text portions which he has just read, or to anticipate what thoughts come next, the field of the translucent layer around window 16 permits him to see and integrate those passages with the principal passage inside the window.

Preferably, the field of the translucent layer 22 outside of window 16 is colored a violet-gray blue drawn from the group of Pantone® colors which are numbered 291C, 283C, 284C, 277C, 278C, 2708C, 271C, 542U, 543U, 544U, 545U, 549U, 550U, 551U, 552U, 5275U, 5285U, 5295U, 5305U, 5415U, 5425U, 5435U, 5445U and 5455U. It has been found that these color tones are preferred by readers using the tool 10, especially reading teachers and their students. It appears to be important to them that the translucent layer 22 is a non-glare field as well as a tinted hue, and blue is the color predominantly chosen. The colors in the group of Pantone® colors specified here were the most frequently selected.

Figure 3:
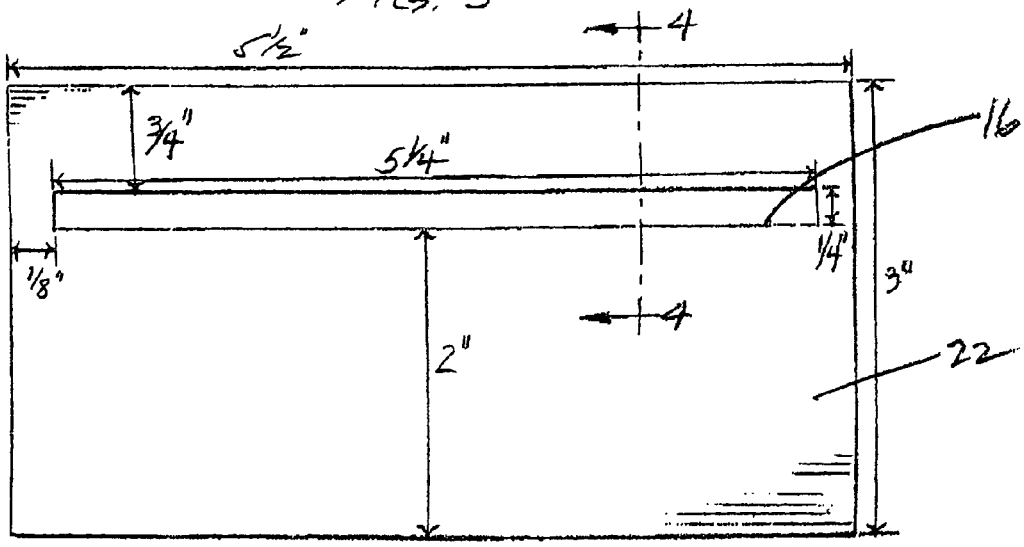
FIG. 3 is a plan view of the reading tool of FIG. 1.

The window 16 is spaced apart from the outer edges of the tool 10 so that the colored field of the translucent layer surrounds window 16. As shown in the plan view of FIG. 3, tool 10 is preferably 5½ inches long and 3 inches high. Window 16 is ¼ inches high to accommodate the normal height of type in a printed line. Twelve point type, for example, is about ⅛ inches high. The top edge of window 16 is ¾ inches from the top edge of tool 10, and the bottom edge of window 16 is 2 inches up from tool 10's bottom edge. Preferably, the window 16 is 5¼ inches long, making the ends of the window ⅛ inches inwardly from the side edges of tool 10. Using these dimensions, the window 16 is sized to disclose groups of words in a line of text which will provide optimal "chunks" of absorbable content for a reader using the tool.

In embodiments of this invention which are intended to be used where the chunks of information take up longer portions of a line of type, the tool 10 may be elongated, but all of the foregoing dimensions except the length of tool 10 and window 16 remain the same, namely the length of tool 10 may be 8⅜ inches and the length of the window 16 may be 8⅛ inches. In this modification, the top of window 16 is still located 3 inches from the top edge of the tool, and the bottom edge of window 16 is still located 2 inches up from the bottom edge of the tool. Window 16 is still surrounded by the colored portion of the translucent layer as above described.

Although particular forms of the invention have been illustrated and described, nevertheless various modifications can be made without departing from the true spirit and scope of the invention. Accordingly, no limitation is intended by the foregoing description, and its full breadth is intended to be covered in the following claims.

I claim:

1. A reading tool comprising a flexible layer of transparent film forming a first panel and readily conformable to the surface of a page on which there are lines of text to be read, and a flexible layer of colored translucent film adhered to the flexible transparent layer of film forming a transparent window surrounded by colored translucent film adjacent the first panel and readily conformable to the surface of the page on which there are lines of text to be read, the first panel and the window disclosing a view through the first panel and the window of one of the lines of text which contrasts to colored views of portions of the text appearing through the translucent layer contiguous to and extending outwardly from the window.

2. The reading tool of claim 1 in which the window is located at a distance from the edges of the tool.

3. The reading tool of claim 1 in which the translucent layer is a non-glare color tinted film.

4. The reading tool of claim 3 in which the translucent layer is blue.

5. The reading tool of claim 4 in which the blue color of the translucent layer is a violet-gray blue.

6. The reading tool of claim 5 in which the violet-gray blue is one of the group of Pantone® colors numbers 291C, 283C, 284C, 277C, 278C, 2708C, 271C, 542U, 543U, 544U, 545U, 549U, 550U, 551U, 552U, 5275U, 5285U, 5295U, 5305U, 5415U, 5425U, 5435U, 5445U and 5455U.

7. The reading tool of claim 1 in which the window is sized to disclose groups of words in a line of the text.

8. The reading tool of claim 1 in which the transparent layer has top and bottom edges 5½ inches long.

9. The reading tool of claim 8 in which the window has a top edge ¾ inches from the top edge of the transparent layer and a bottom edge 2 inches from the bottom edge of the transparent layer.

10. The reading tool of claim 1 in which the transparent layer has side edges 3 inches long.

11. The reading tool of claim 10 in which the side edges of the window are ⅛ inches from the side edges of the transparent layer.

12. The reading tool of claim 1 in which the window has top and bottom edges 5¼ inches long.

13. The reading tool of claim 1 in which the window has side edges ¼ inches long.

14. The reading tool of claim 1 in which the transparent layer has top and bottom edges 8⅜ inches long.

* * * * *